US005186105A

United States Patent [19]

Emrich et al.

[11] Patent Number: 5,186,105

[45] Date of Patent: Feb. 16, 1993

[54] DEVICE FOR MONITORING SHEET MOVEMENT NEAR THE LAY MARKS OF SHEET-FED OFFSET PRINTING PRESSES

[75] Inventors: Helmut Emrich, Offenbach am Main; Horst Muller, Seligenstadt; Walter Ruwe, Offenbach am Main; Erich Wegel, Muhlheim am Main, all of Fed. Rep. of Germany

[73] Assignee: Man Roland Druckmaschinen AG, Fed. Rep. of Germany

[21] Appl. No.: 869,315

[22] Filed: Apr. 15, 1992

[30] Foreign Application Priority Data

Apr. 15, 1991 [DE] Fed. Rep. of Germany ..... 4112222

[51] Int. Cl.[5] ..... B41F 7/02

[52] U.S. Cl. ..... 101/217; 101/232; 101/248; 250/548; 271/277

[58] Field of Search ..... 101/248, 232, 233, 246, 101/235, 216, 217, 136; 250/548; 271/277

[56] References Cited

U.S. PATENT DOCUMENTS

| | | | |
|---|---|---|---|
| 3,858,052 | 12/1974 | Luska | 250/548 |
| 4,220,084 | 9/1980 | MacLean et al. | 101/232 |
| 4,428,288 | 1/1984 | Harper et al. | 101/248 |
| 4,458,893 | 7/1984 | Ruh | 271/277 |
| 4,484,522 | 11/1984 | Simeth | 101/248 |
| 4,581,993 | 4/1986 | Schönieberger | 101/217 |
| 4,635,546 | 1/1987 | Grossman et al. | 101/216 |
| 4,647,033 | 3/1987 | Emrich . | |
| 4,651,984 | 3/1987 | Emrich . | |
| 4,665,498 | 5/1987 | Buschmann et al. . | |
| 4,905,595 | 3/1990 | Jeschke et al. | 101/246 |
| 4,945,830 | 8/1990 | Maehara | 101/217 |

FOREIGN PATENT DOCUMENTS

| | | |
|---|---|---|
| 3907583 | 9/1990 | Fed. Rep. of Germany . |
| 4019293 | 1/1991 | Fed. Rep. of Germany . |
| 2071064 | 2/1981 | United Kingdom . |

OTHER PUBLICATIONS

Uberwachungs-und Mefzeinrichtungen Bogen-Offset-druckmaschinen, Ing. K. H. Forster, Oberarbeitcter Vortrag zur Pira-Iarigai-Konferenz, Nov. 1975.

*Primary Examiner*—Eugene H. Eickholt
*Attorney, Agent, or Firm*—Leydig, Voit & Mayer

[57] ABSTRACT

A device for monitoring sheet movement near the lay marks of sheet-fed offset printing presses. To ensure that a sheet has sufficient time to settle on the lay marks, the invention automatically selects between two instants at which sheet position is detected based on the state of the press (printing on or printing off). Since, depending on the state of the press, different procedures are performed before printing, selection of different instants of sensing provide a sheet the maximum amount of time possible for settling before detection.

4 Claims, 3 Drawing Sheets

DEVICE FOR MONITORING SHEET MOVEMENT NEAR THE LAY MARKS OF SHEET-FED OFFSET PRINTING PRESSES

FIELD OF THE INVENTION

The invention relates generally to sheet-fed offset printing presses, and more particularly to a device for monitoring sheet movement near the lay marks of sheet-fed offset printing presses.

BACKGROUND OF THE INVENTION

At the high speeds at which sheet-fed offset presses are typically run, the sheets to be printed are removed from a feed stack and conveyed in a part-overlapping relationship to a set of lay marks (positioning guides) by way of a conveying table, such as a suction belt table described in U.S. Pat. No. 4,647,033 (corresponding to German Pat. DE 3 138 481 C2). The front edge of the sheet is aligned on a front lay mark in the direction of sheet movement, such as by the additional conveying means of U.S. Pat. No. 4,651,984 (corresponding to German Pat. DE 3 331 662 C2), and the side edge of the sheet is aligned on a side lay. When this aligning step is complete, a gripper, usually cam-operated, engages the sheet. Ordinarily, the lay marks are then pivoted away and the gripper transfers the sheet directly to a separate gripper system of an impression cylinder.

The most widely used sheet-fed offset presses have a blanket cylinder eccentrically mounted at both ends so that the blanket cylinder can be completely thrown off the impression cylinder and a plate cylinder by rotation of this eccentric mounting. This mode of operation, when all cylinders have been thrown off, is known as the "printing off" state of operation. For inking, the blanket cylinder is first thrown onto the plate cylinder but is not thrown onto the impression cylinder, and then for printing, the blanket cylinder is also thrown onto the impression cylinder so that all three cylinders operate together. When all three cylinders operate together, the press is in the "printing on" state of operation. The eccentric bearings that enable these throw-on and throw-off movements are operated by cam followers, cam follower levers and actuatable pawls. For proper operation, the throw-on and throw-off of the blanket cylinder with respect to the plate cylinder and impression cylinder must occur at the instant when the gaps of the corresponding printing unit cylinders register with one another. Similarly, as is known from the prior art, the pivoting-away movements of the lay marks and the engagement of the sheet and transfer movements of the gripper are produced by a transmission system also having cam followers, cam follower levers, and pawls which can be engaged to interrupt these movements.

It is also known from the prior art to position sheet sensors near the lay marks for detecting whether the sheet is properly aligned on the lay marks in sufficient time for gripping (detection of late sheets) and to verify that the sheet is engageable by the gripper over its entire width (detection of skewed sheets). Sheet sensors of this kind usually are based on optoelectronic sensing, such as disclosed in German Pat. DE 3 907 583 A1. If the sensing result is negative—i.e., the sheet is not aligning on the lays correctly—the auxiliary gripper does not engage the sheet, the lay marks do not pivot away and the blanket cylinder is thrown off the impression cylinder and plate cylinder. In other words, the press is put into the printing off mode.

These sheet sensors monitor sheet entry both in the printing on and printing off states of operation. In the printing off state, when a sheet is properly sensed, the sheet is gripped, transferred to the impression cylinder, and the blanket cylinder is thrown first onto the plate cylinder and then onto the impression cylinder carrying this first sheet. When this has occurred, the press has changed to the printing on state. In the printing on state subsequent sheets are gripped and transferred to the impression cylinder, but throwing-on movements are unnecessary since the cylinders have already been thrown-on.

When the press is running at high press speeds, the sheets tend to rebound from the lay marks before settling properly and aligning along the lay marks correctly. If the sensor attempts to detect a sheet before it has properly settled (shortly after arrival), sheet movement will be halted.

It is known from British Patent 2,071,064 (corresponding to German Pat. DE 3 044 643 A1) that triggering the mechanical elements for release or stoppage of the sheet, or actuation, is possible even at the maximum press speed. However, because these elements take time to operate, the decision on which elements to actuate must be made at a time that depends on the speed of the press. Therefore, the time at which the sheet must be detected is determined by an angle of rotation from a single-revolution shaft of a cylinder. For example, this time or angle can be derived from a timer or angular position sensor on the shaft. This "instant of sheet sensing" must be chosen so that in the printing on state there is still sufficient time to stop an improper sheet entry, and so that in the printing off state there is still sufficient time for the cylinder throw-on movements to occur and also to load a sheet for printing.

A disadvantage of a rigid association between the instant of sheet sensing and a fixed angle of rotation of a single-revolution shaft is that in some printing units and gripper arrangements, the instant of sheet sensing must occur at an early enough angle so that it is still possible to trigger the start of printing and the release of the sheet for movement. A distinctive feature of these printing units and gripper arrangements is that the angle (time) of a single-revolution shaft at which the blanket cylinder is required to be thrown onto the plate cylinder (so that the gaps of these cylinders correspond) occurs before the angle (time) at which release of the sheet for movement is possible, (pivoting away of the lay marks, triggering of the gripper) and all movements must begin before the angle (time) at which the blanket cylinder can be thrown onto the impression cylinder.

With such a system, the instant of sheet sensing must be chosen so that it will occur before any of the movements begin. The first movement that could possibly occur is the throwing-on of the plate cylinder to the blanket cylinder, when printing is off. Therefore, the instant of sheet sensing must take place prior to this first throw-on movement. In other words, the latest possible angle that can be chosen must precede the angle at which this first throw-on movement must begin.

In the printing off state, there is always sufficient time for settling to occur, and the angle chosen corresponding to the instant of sheet sensing presents no problems. However, when the press is in the printing on state, problems occur at high printing speeds because the settling time of a sheet often exceeds the time it takes for this chosen sensing angle to be reached by the rotating shaft. Consequently, sheet movement is frequently stopped and the press goes into the printing off state, even though the sheet would have settled in plenty of time to be properly gripped. This phenomenon occurs almost every time the sheets are supplied to the press in an overlapping relationship at high press speeds.

German patent DE 4 019 293 A1 describes a facility for monitoring sheets on the lay marks of presses wherein the instant of sensing is variable and is selected in inverse proportion to press speed. The alleged aim is to increase the time available for the sheet to settle on the lay marks. However, a facility of this kind only makes allowances for the time taken between an actuation signal given and the actual operation of the mechanical elements, by advancing the actuation signal at high press speeds. Accordingly, the instant of sheet sensing must also be advanced. Sheet settlement time is therefore not increased at all.

SUMMARY OF THE INVENTION

It is therefore an object of the invention to construct a device so that the sheet is given sufficient time to settle on the lay marks even at very high press speeds in both the printing on and printing off states of a press, that is, regardless of the arrangements of the printing cylinders and of the gripper relative to the impression cylinder.

Briefly, the present invention provides a device that allows for increased settling time of a sheet when the press is in the printing on state of operation. This is accomplished by automatically selecting between two different angles or times to detect the sheet depending on whether the press is in the printing on or printing off state of operation.

When the press is in the printing on state, it does not require any time to throw-on the cylinders, because in this state they already have been thrown-on. Thus, in the printing on state, it is not necessary to allow for the throw-on time when choosing an angle (time) at which to detect the sheet position. As a result, a second, later angle (time) can be chosen. This later angle only needs to precede the angle at which actuation of the gripper must begin, and not the earlier time required for the first throw-on movement. The settling time is consequently increased by a relatively substantial amount when the press is in the printing-on state.

When the press is in the printing off state, the first angle of sensing must still precede the time required for the initial throw-on movement to occur. However, time in this state of operation is not critical because the cylinders are already separated when printing is off. If the sheet does not settle properly before the required angle is reached, it can still do so by the next revolution without any change in the state of operation.

By selecting between appropriate angles (times) for sheet detection based on the state of press operation, the invention allows for increased settling time of sheets, eliminating frequent detection of misfeeds that occur at high speed printing when the press is in the printing on state.

Other objects and advantages of the present invention will become apparent upon consideration of the following detailed description when taken in conjunction with the drawings.

While the invention will be described in connection with certain preferred embodiments, it will be understood that it is not intended to limit the invention to these particular embodiments. On the contrary, it is intended to cover all alternatives, modifications and equivalent arrangement as may be included within the spirit and scope of the invention.

DETAILED DESCRIPTION OF THE PREFERRED EMBODIMENT

Figure 1A:
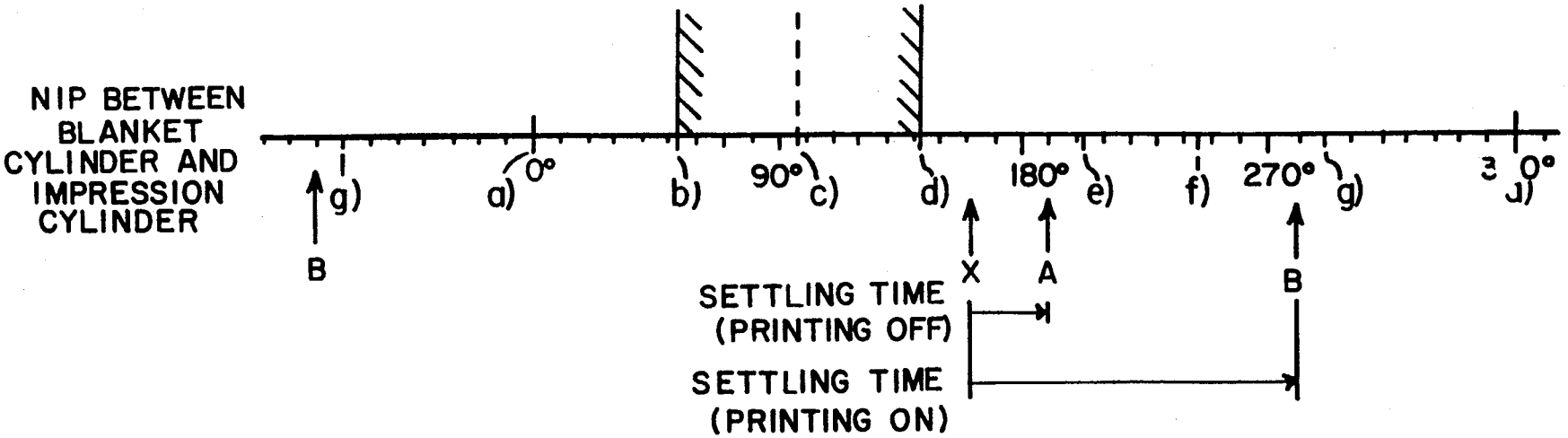
FIG. 1*a* is a diagram illustrating the nip between the blanket cylinder and the impression cylinder over slightly more than one revolution of the blanket cylinder with significant angles of rotation identified.

FIG. 1*a* is a diagram illustrating the nip between the blanket cylinder and the impression cylinder over slightly more than one revolution of the blanket cylinder. Angles a)–g) correspond to the angles of the cylinders in FIGS. 2*a*–2*g*, with angle a) being chosen as the angle where gripping of a sheet first begins, calibrated as 0 degrees. The area between angles b) and d) denotes the angular interval during which the gaps in the circumferential printing areas of the blanket cylinder and impression cylinder are in registration. Angle c) denotes the angle where the gaps are the center of their registration. It is only during the interval from b) to d) that throw-on and throw-off of the blanket cylinder and impression can occur.

Figure 1B:
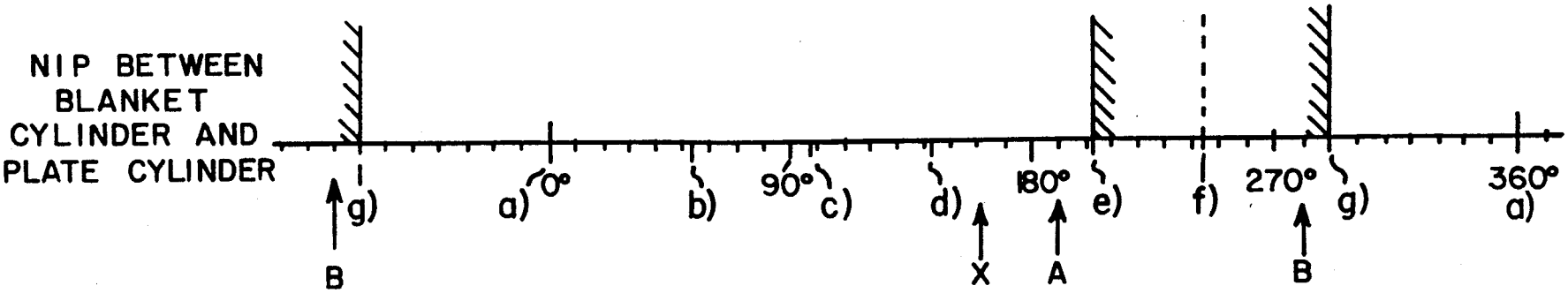
FIG. 1*b* is a diagram illustrating the nip between the blanket cylinder and the plate cylinder over slightly more than one revolution of the blanket cylinder with significant angles of rotation identified.

FIG. 1*b* is a diagram illustrating the nip between the blanket cylinder and the plate cylinder over slightly more than one revolution of the blanket cylinder. Angles a)–g) correspond to the angles of the cylinders in FIGS. 2*a*–2*g*, with angle a) being chosen as the angle where gripping of a sheet first begins, calibrated as 0 degrees. The area between angles e) and g) denotes the angular interval during which the gaps in the circumferential printing areas of the blanket cylinder and plate cylinder are in registration. Angle f) denotes the angle where the gaps are at the center of their registration. It is only during the interval from e) to g) that throw-on and throw-off of the blanket cylinder and plate cylinder can occur.

FIGS. 2*a*–2*g* are a timing sequence showing the printing unit while in the printing on state. Each FIGS. 2*a*–2*g* corresponds to an angle a)–g) in FIGS. 1*a* and 1*b*. The figures show an impression cylinder IC, a blanket cylinder BC and a plate cylinder PC cooperating with each other in a known manner. The hatched zones of the cylinders represent the gaps in the circumferential printing area of the cylinders which must be in registration when throwing-on and throwing-off movements occur. The impression cylinder IC is shown as a double-size cylinder, however, this is not necessary to the invention.

Figure 2B:
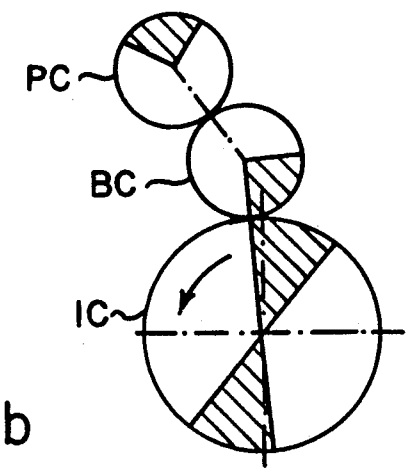
FIGS. 2*a*–2*g* show the arrangement of printing cylinders of a sheet-fed offset press and the relative positions of their gaps in a timing sequence corresponding to angles a)–g) identified in FIGS. 1*a* and 1*b*.
Figure 2C:
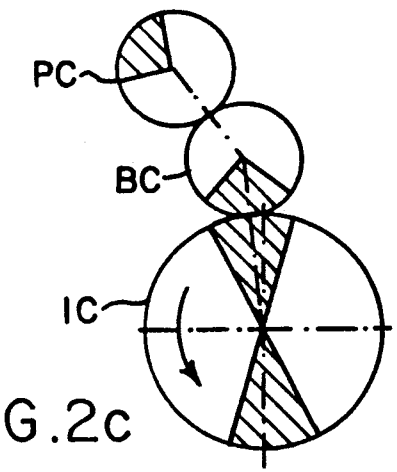
Figure 2D:
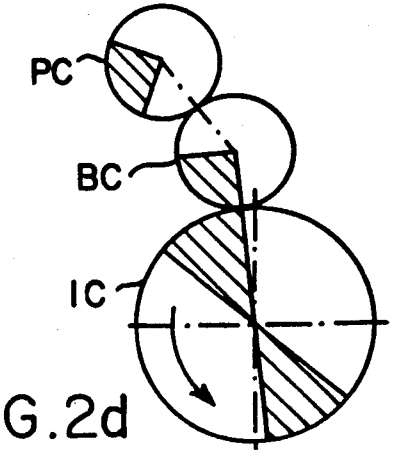
Figure 2E:
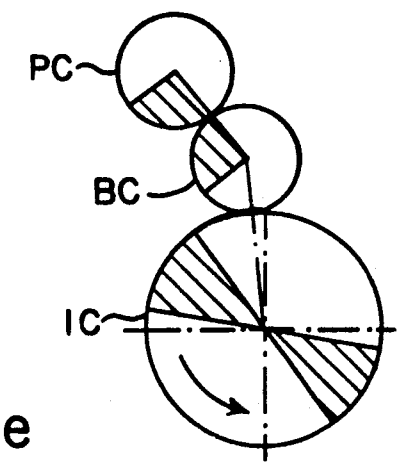
Figure 2F:
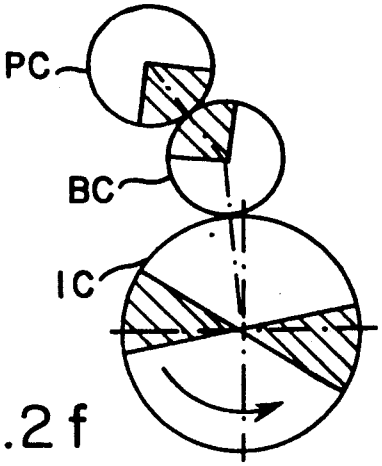
Figure 2G:
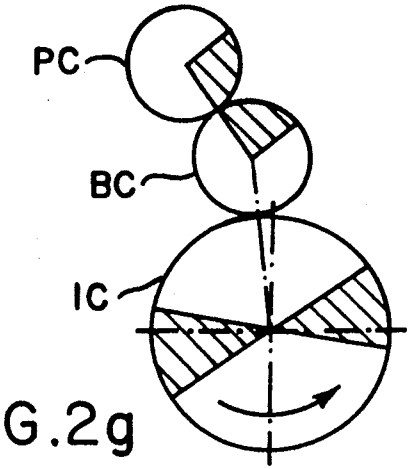
Figure 2A:
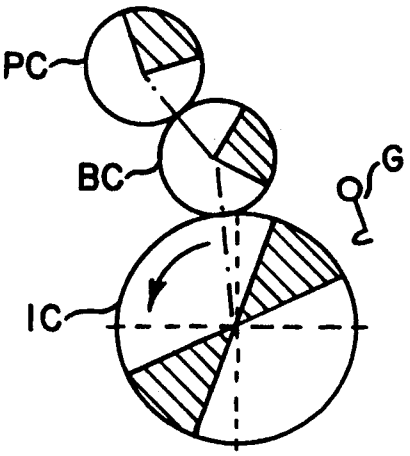

FIG. 2*a* shows the relative position of the cylinders at the angle when the previous sheet is still being printed out and a new sheet that has been properly aligned is first being engaged by the gripper G. Inking of the blanket cylinder BC by the plate cylinder PC is also occurring at this time.

FIG. 2*b* shows the relative positions of the cylinders at an angle when the previous sheet has just finished being printed and the gaps of the blanket cylinder BC and the impression cylinder IC first begin to register with each other.

FIG. 2*c* illustrates the relative positions of the cylinders at the angle when the centers of the gaps of the blanket cylinder BC and the impression cylinder IC correspond. This is the optimal angle at which the blanket cylinder BC should be thrown off the impression cylinder IC, since at this angle the cylinders are in perfect registration. This angle is not required to be the exact angle, however, as it is only necessary for throw-on and throw-off to occur at anytime when the gaps are in registration. The throw-off movement (not shown) consists of a cam, a cam follower lever and a pawl (not shown), operating in a known manner, wherein the pawl can only engage in corresponding detents when the gaps are in registration. Because these mechanical elements take some reaction time to actuate, the command to actuate must be advanced corresponding to the press speed. Accordingly, the faster the press speed, the earlier the decision to throw off a cylinder must be made.

FIG. 2*d* illustrates the relative positions of the cylinders at the angle when the gaps of the blanket cylinder BC and the impression cylinder IC are ending their registration and a new sheet is beginning to be printed. Referring to FIG. 1*a*, soon after this angle d) where the sheet begins printing, a new sheet is being conveyed to the lay marks, as denoted by angle X.

FIG. 2*e* shows the relative position of the cylinders at the angle when the gaps of the plate cylinder PC and blanket cylinder BC are first beginning to register. Because of the design of the mechanical elements responsible to throw-on and throw-off movements, the throw-on and throw-off movements of these two cylinders can only occur while this registration is taking place. FIG. 2*f* shows the optimal angle for throw-on or throw-off of the plate cylinder and blanket cylinder, although the registration does not actually end until a later time, as shown by FIG. 2*g*. Again, since these mechanical elements responsible for throw-on and throw-off movements require a reaction time (e.g., a time to overcome inertia, friction, etc.), the decision to throw-on or throw-off the cylinders must be made in advance, depending on the press speed. Indeed, if the speed is high enough, a decision has to be made even before the start of registration occurs. Thus, referring to FIG. 1*a*, angle A shows the angle at which throw-on or throw-off must begin. The actual angle A will vary according to printing speed so that the faster the press, the shorter the interval between angle A and angle X.

When the press is in a printing off state, sheet sensing must occur at angle A so that there is sufficient time to throw the plate cylinder PC onto the blanket cylinder BC. Since the interval between X and A (X–A), shown in FIG. 1*a* as the settling time (printing off), becomes very small at high speeds, it often takes longer for the sheet to settle than for the cylinder to rotate past this interval. This is not a problem in the printing off state since the cylinders are already thrown-off from each other awaiting sheet detection. Once the sheet does settle and the cylinders (shaft) achieve angle A on the next revolution, printing can be begin.

However, in the printing on state, the entire press is disrupted by a sheet that is not properly detected. Sheet movement is halted and the impression cylinder IC must first be thrown off the blanket cylinder BC, which can only occur at the interval between angles b) and d) of FIG. 1*a*. Then the plate cylinder PC is thrown off the blanket cylinder BC at the interval from e) to g) of FIG. 1*b*. At high press speeds, the interval (X–A) becomes too small for continuous printing on operation because printing is often interrupted by attempting to detect the sheet before it settles.

Therefore, according to the invention, a second, later angle B is used as the angle at which to monitor sheet alignment when the printer is in the printing on state. Note that B would occur far too late to be used as a sensing angle in the printing off state. The invention, however, automatically selects which angle to use based on the state of the press. Consequently, when in the printing on state, a much longer interval, (X–B), shown in FIG. 1*a* as the settling time (printing on), is available for the sheet to settle before sensing occurs. Selection of this later angle is possible because a throw-on movement is not required in the printing on state. Thus, angle B only needs to occur in time for the sheet to be gripped.

Figure 3:
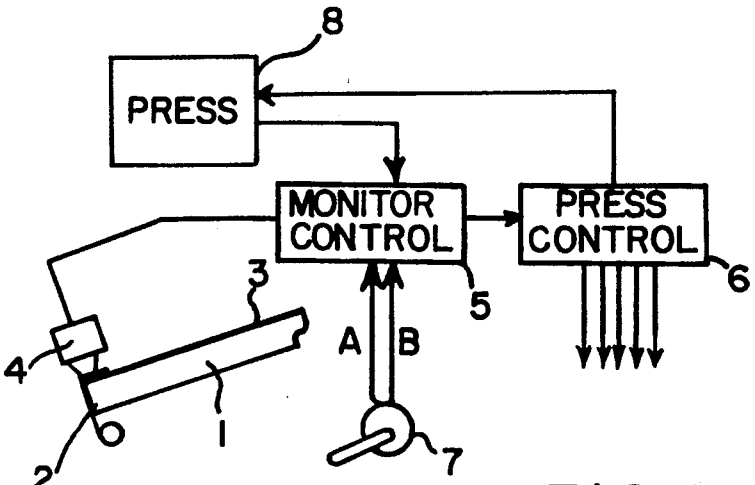
FIG. 3 is a block diagram of the sheet monitoring device of the present invention.

FIG. 3 illustrates a preferred embodiment. A feed table 1 conveys a sheet 3 for alignment on the lay marks 2. The lay marks 2 can be pivoted away for further sheet movement once the sheet 3 is properly aligned. To monitor sheet alignment, sheet sensors 4, shown in FIG. 3 as optoelectronic sensors, are positioned near the lay marks 2. Other sensing means such as mechanical, ultrasonic, or capacitive sensors could be used for sheet detection. Additionally, two sheet sensors 4 could be used simultaneously at separate locations for detection of skewed sheets.

The sheet sensors 4 are connected to a monitor control 5 for detection of proper sheet alignment at the appropriate times. The monitor control 5 determines these times from a timer or angular position sensor 7 of conventional design, which provides at least two pulses corresponding to angles A and B as shown in FIGS. 1*a* and 1*b*. The monitor control 5 is also connected to the press 8, which is adapted to convey information indicative of whether the press 8 is in the printing on or printing off state of operation. Depending upon the state of the press 8, the monitor control selects either pulse A or B as the moment to evaluate the signals from the sheet sensors 4. Sheet sensing can occur either momentarily during pulses A and B, or can occur continuously and be monitored only at times A and B. Regardless of how sensing is actually performed, the monitor control 5 evaluates the sheet sensors 4 at a time A or B according to the state of press 8 and communicates the result to the press control 6. The press control 6 then operates the mechanical elements (not shown) that control press operation. For example, these mechanical elements might be the actuating means that perform the throw-on and throw-off movements, control the gripper, and pivot the lay marks. Press control 6 can also be responsible for operating these mechanical elements depending on the angle of rotation and press speed.

We claim as our invention:

1. A device for monitoring movement of a sheet to be printed in a sheet-fed offset printing press, including:

a press having rotating cylinders in a plurality of operating states and for providing a value indicative of the operating state of the cylinders;

means for transferring one of the sheets to the press;

a sheet sensor for detecting the position of the sheet on the transferring means and providing a value indicative thereof;

means for detecting at least two different angular positions of the rotating cylinders;

a monitor control unit responsive to the values from the press and sheet sensor and the at least two different angular positions of the rotating cylinders for 1) selecting one of the angular positions, depending on the value of the operating state of the cylinders, 2) evaluating the value indicative of the position of the sheet at the moment corresponding to the selected angular position, and 3) providing an output indicative of the sheet position at the selected angular position; and means for receiving the output generated by the monitor control unit and controlling the press in accordance with the output received.

2. A device as set forth in claim 1 wherein the sheet sensing means are optoelectronic sensors.

3. A device as set forth in claim 1 wherein the means for detecting angular positions of the cylinders is an angular position sensor.

4. A device as set forth in claim 1 wherein the means for detecting angular positions of the cylinders is a timer.

* * * * *